US009350109B2

(12) United States Patent
Ohnuma et al.

(10) Patent No.: US 9,350,109 B2
(45) Date of Patent: May 24, 2016

(54) COMPRESSION METHOD FOR ELECTRIC WIRE AND ELECTRIC WIRE WITH TERMINAL OBTAINED THEREBY

(71) Applicant: Yazaki Corporation, Tokyo (JP)

(72) Inventors: Kentaro Ohnuma, Makinohara (JP); Tadahisa Sakaguchi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 170 days.

(21) Appl. No.: 14/175,400

(22) Filed: Feb. 7, 2014

(65) Prior Publication Data

US 2014/0151083 A1 Jun. 5, 2014

Related U.S. Application Data

(63) Continuation of application No. PCT/JP2012/070721, filed on Aug. 8, 2012.

(30) Foreign Application Priority Data

Aug. 8, 2011 (JP) ..... 2011-173341

(51) Int. Cl.
*H01R 13/40* (2006.01)
*H01R 13/52* (2006.01)
(Continued)

(52) U.S. Cl.
CPC ..... *H01R 13/52* (2013.01); *H01R 4/184* (2013.01); *H01R 4/20* (2013.01); *H01R 4/62* (2013.01)

(58) Field of Classification Search
CPC ..... H01R 13/52; H01R 4/20; H01R 4/62; H01R 4/18; H01R 4/184; H01R 43/05; H01R 43/048; Y10T 29/49185
USPC ..... 174/93; 439/587, 877; 29/863
See application file for complete search history.

(56) References Cited

U.S. PATENT DOCUMENTS 2,806,215 A * 9/1957 Redslob ..... 439/868
2,815,497 A 12/1957 Redslob
(Continued)

FOREIGN PATENT DOCUMENTS

EP 1617517 A1 1/2006
JP 2000251961 A 9/2000
(Continued)

OTHER PUBLICATIONS

International Search Report dated Nov. 8, 2012 from the International Searching Authority in counterpart application No. PCT/JP2012/070721.
(Continued)

*Primary Examiner* — Timothy Thompson
*Assistant Examiner* — Guillermo Egoavil
(74) *Attorney, Agent, or Firm* — Sughrue Mion, PLLC

(57) ABSTRACT

An electric wire with terminal includes: a waterproof seal sleeve that is attached to a tip of a conductor part of a covered electric wire from which a covering section is removed; an inner terminal that is compressed in an area containing a boundary between the conductor part and the covering section of the covered electric wire; and an outer terminal which includes an electric connection section connected to a mating terminal, a compression section having a front part, a center part and a rear part, and an interconnecting section that connects the electric connection section with the compression section. The front part of the compression section compresses the waterproof seal sleeve, the center part of the compression section compresses the conductor part, and the rear part of the compression section compresses a front part of the inner terminal.

5 Claims, 6 Drawing Sheets

(51) Int. Cl.

| | |
|---|---|
| ***H01R 4/18*** | (2006.01) |
| ***H01R 4/20*** | (2006.01) |
| ***H01R 4/62*** | (2006.01) |

(56) References Cited

U.S. PATENT DOCUMENTS

| | | | | |
|---|---|---|---|---|
| 2,951,228 | A | 8/1960 | Cobaugh | |
| 2001/0005647 | A1 | 6/2001 | Endo et al. | |
| 2002/0058447 | A1 | 5/2002 | Endo et al. | |
| 2006/0014412 | A1 | 1/2006 | Lutsch et al. | |
| 2011/0067239 | A1* | 3/2011 | Martauz | H01R 4/184 29/885 |
| 2012/0329341 | A1* | 12/2012 | Morikawa | H01R 4/185 439/866 |
| 2012/0329342 | A1* | 12/2012 | Sato | H01R 4/184 439/866 |
| 2012/0329343 | A1* | 12/2012 | Sato et al. | 439/866 |

FOREIGN PATENT DOCUMENTS

| | | | | |
|---|---|---|---|---|
| JP | 2004207172 | A * | 7/2004 | |
| JP | WO 2011115004 | A1 * | 9/2011 | H01R 4/20 |

OTHER PUBLICATIONS

Written Opinion dated Nov. 8, 2012 from the International Searching Authority in counterpart application No. PCT/JP2012/070721.

* cited by examiner

COMPRESSION METHOD FOR ELECTRIC WIRE AND ELECTRIC WIRE WITH TERMINAL OBTAINED THEREBY

CROSS REFERENCE TO RELATED APPLICATIONS

This application is a continuation of PCT application No. PCT/JP2012/070721, which was filed on Aug. 8, 2012 based on Japanese Patent Application No. 2011-173341 filed on Aug. 8, 2011, the contents of which are incorporated herein by reference.

BACKGROUND OF THE INVENTION

1. Field of the Invention

The present invention relates to an electric wire compression method compressing a conductor part of an electric wire to a compression terminal, and an electric wire with a terminal obtained by the method.

2. Description of the Related Art

In the related art, as an example of the electric wire compression method of compressing a conductor part of the electric wire to the compression terminal, a method of placing a conductive member has been known (for example, see JP-A-2000-251961).

The compression terminal disclosed in JP-A-2000-251961 is constituted by an electrical contact section and a wire compression section, and the wire compression section is formed with a conductor compression section for compression the conductor part of the electric wire, and a cover compression section for compression a covering section of the electric wire. The conductor compression section is provided with a stripe-like conductive member. The conductive member contributes to embedding a gap between the conductor compression section and the conductor part generated during compression in a gas-tight state.

SUMMARY OF THE INVENTION

According to the art described in JP-A-2000-251961, a method of manufacturing the compression terminal with high compression reliability and easy process management is obtained. Since an aluminum electric wire is normally used as the electric wire and a copper terminal is used as the terminal, when water enters the compression section, it has been found that galvanic corrosion due to an electric potential difference between different metals is generated, and there is a concern that the electric resistance of the compression section may rise and mechanical fixing force may fall.

For this reason, there is a need for an electric wire with a terminal including a corrosion prevention technique.

In order to prevent the corrosion, (a) a technique of inserting a rubber cap into the electric wire or (b) a technique of applying resin to an end section of an electric wire is considered. However, since a rubber cap insertion tool is required for the insertion of the rubber cap and a resin application tool is required for the resin application, flexible production has been difficult.

The present invention has been made under the circumstances mentioned above, and an object thereof is to provide an electric wire compression method and an electric wire with a terminal in which galvanic corrosion due to the electric potential difference between the different metals is not generated even in an electric wire with the terminal using an aluminum electric wire and a copper terminal, and thus there is no concern that the electric resistance of the compression section may rise and the mechanical fixing force may fall.

In order to achieve the object, the present invention may provide any one of the following configurations (1) to (8).

(1) A compression method for an electric wire for compressing a terminal to a conductor part exposed by removing a covering section of a covered electric wire to form an electrically connected electric wire with the terminal, the compression method including:

removing the covering section of the covered electric wire;

setting an inner terminal to in an area containing a boundary between the conductor part from which the covering section is removed and the covering section, and compressing and connecting the inner terminal;

attaching a waterproof seal sleeve to a tip of the conductor part of the covered electric wire; and in an outer terminal that includes an electric connection section connected to a mating terminal, a compression section having a front part, a center part and a rear part, and an interconnecting section that connects the electric connection section with the compression section, setting the waterproof seal sleeve in the front part of the compression section, setting the conductor part in the center part of the compression section, setting a front part of the inner terminal in the rear part of the compression section, and compressing the outer terminal, whereby securing a seal of the waterproof seal sleeve in the front part of the compression section of the outer terminal, a seal of the inner terminal in the rear part of the compression section and a conduction with the conductor part in the center part of the compression section.

(2) The compression method according to the configuration (1), wherein the waterproof seal sleeve includes a seal sleeve having a cap shape formed of metal or resin.

(3) The compression method according to the configuration (1), wherein a serration formed of a plurality of concavities and convexities is provided in the center part of the compression section of the outer terminal.

(4) The compression method according to the configuration (1), wherein a taper sloping while causing its diameter to be narrower as goes forward is formed at least in the front part of the inner terminal or the rear part of the outer terminal to fill a gap between the front part of the inner terminal and the rear part of the outer terminal.

(5) An electric wire with terminal, including:

a waterproof seal sleeve that is attached to a tip of a conductor part of a covered electric wire from which a covering section is removed;

an inner terminal that is compressed in an area containing a boundary between the conductor part and the covering section of the covered electric wire; and an outer terminal which includes an electric connection section connected to a mating terminal, a compression section having a front part, a center part and a rear part, and an interconnecting section that connects the electric connection section with the compression section, wherein the front part of the compression section compresses the waterproof seal sleeve, the center part of the compression section compresses the conductor part, and the rear part of the compression section compresses a front part of the inner terminal.

(6) The electric wire with terminal according to the configuration (5), wherein the waterproof seal sleeve includes a seal sleeve having a cap shape formed of metal or resin.

(7) The electric wire with terminal according to the configuration (5), wherein a serration formed of a plurality of concavities and convexities is provided in the center part of the compression section of the outer terminal.

(8) The electric wire with terminal according to the configuration (5), wherein a taper sloping while causing its diameter to be narrower as goes forward is formed at least in the front part of the inner terminal or the rear part of the outer terminal to fill a gap between the front part of the inner terminal and the rear part of the outer terminal.

According to the electric wire compression method of (1) mentioned above, since a waterproof seal sleeve is attached to a tip of a conductor part from which a covering section is removed, and the seal sleeve is compressed and connected by an outer terminal, a gap allowing water to enter is not formed between a tip of the conductor part and the outer terminal. Thus, since water does not enter, even in an aluminum electric wire and an electric wire using a copper terminal, galvanic corrosion due to an electric potential difference between different metals is not generated. Accordingly, there is no concern that the electric resistance of a compression section may rise and mechanical fixing force may drop.

According to the electric wire compression method of (2) mentioned above, since a cap-shaped seal sleeve formed of metal or resin is used as the waterproof seal sleeve, the waterproofing can be simply and reliably performed, and thus productivity is improved.

According to the electric wire compression method of (3) mentioned above, a serration formed of a plurality of concavities and convexities is provided in a center part of a compression section of the outer terminal, and the serration is strongly compressed to the conductor part of the tip of the covered electric wire. Thus, even when the conductive member as in JP-A-2000-251961 is not used, the relative movement is not performed, and the conduction can be secured.

According to the electric wire compression method of (4) mentioned above, since a gap is not formed in the compression part between them, the compression effect is increased, and a step is not formed outside the compression part between them.

According to the electric wire with terminal of (5) mentioned above, since the seal sleeve made of metal or resin is attached to the tip of the conductor part, and the seal sleeve is crimped by the outer terminal, a gap allowing water to enter is not formed between the conductor part tip and the inner terminal. Thus, since water does not enter, even in the aluminum electric wire and the electric wire with the terminal using the cooper terminal, galvanic corrosion due to the electric potential difference between the different metals is not generated. Thus, there is no concern that the electrical resistance of the compression section may rise and the mechanical fixing force may drop.

According to the electric wire with terminal of (6) mentioned above, since a cap-shaped seal sleeve formed of metal or resin is used as the waterproof seal sleeve, the waterproofing can be simply and reliably performed, and thus productivity is improved.

According to the electric wire with terminal of (7) mentioned above, a serration formed of a plurality of concavities and convexities is provided in a center part of a compression section of the outer terminal, and the serration is strongly compressed to the conductor part of the tip of the covered electric wire. Thus, even when the conductive member as in JP-A-2000-251961 is not used, the relative movement is not performed, and the conduction can be secured.

According to the electric wire with terminal of (8) mentioned above, since a gap is not formed in the compression part between them, the compression effect is increased, and a step is not formed outside the compression part between them.

DETAILED DESCRIPTION OF THE EXEMPLARY EMBODIMENTS

Embodiments of the present invention, in which galvanic corrosion due to the electric potential difference between different metals is not generated even in an aluminum electric wire and an electric wire with a copper terminal, will be described below in detail based on the drawings.

<Compression Using Inner Terminal 30>

Figure 1A:
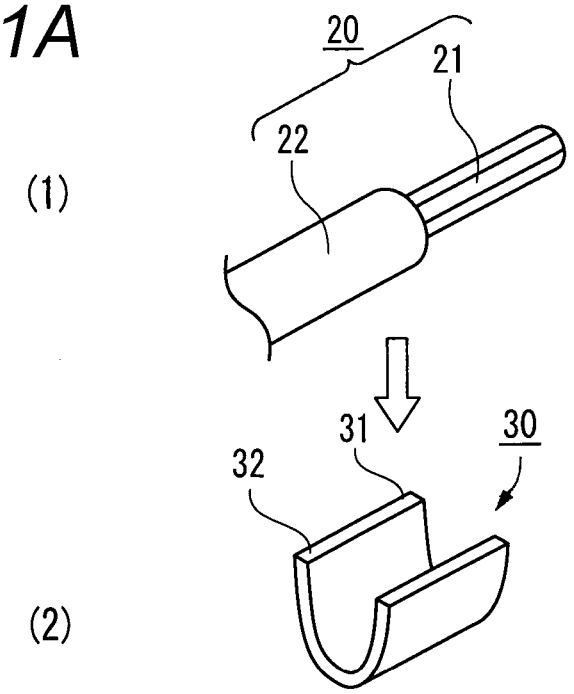
FIG. 1A is a perspective view before compressing an inner terminal to a covered electric wire, in which: (1) is a perspective view of the covered electric wire in which a conductor part is exposed by removing a covering section; and (2) is a perspective view of the inner terminal to be compressed to the covered electric wire.

In a first embodiment of the present invention, in FIG. 1A, (1) is a perspective view of a covered electric wire 20. The covered electric wire 20 is configured so that a conductor part 21 is received in a covering section 22, and, for example, a multi-cored aluminum wire is selected as the conductor part 21. When setting and compressing the vicinity of a boundary, i.e., an area containing the boundary between the conductor part 21 of the covered electric wire 20 in which the conductor 21 is exposed by removing the covering section 22 and the covering section 22 to the bottom of the inner terminal 30 having a U-shaped cross-section in (2) of FIG. 1A, the electric wire with the inner terminal is obtained in which the conductor part 21 of the covered electric wire 20 and the covering section 22 are compressed by the inner terminal 30 as shown in FIG. 1B.

<Electric Wire with Inner Terminal>

The inner terminal 30 is configured so that the conductor part 21 of the covered electric wire 20 is crimped (or compressed) by a front part 31 thereof by bending a conductive metal, and the covering section 22 of the covered electric wire 20 is crimped (or compressed) by a rear part 32 thereof. When using the inner terminal 30, as shown in FIG. 1B, the electric wire with the terminal is obtained in which the front part 31 of the inner terminal 30 is compressed to the conductor part 21 of the covered electric wire 20, and the rear part 32 of the inner terminal 30 is compressed to the covering section 22 of the covered electric wire 20.

Figure 1B:
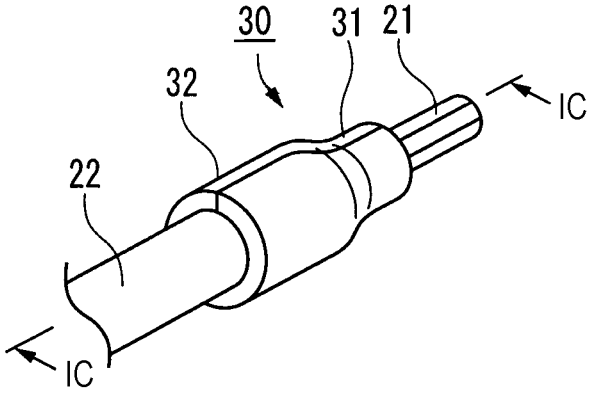
FIG. 1B is a perspective view after compressing the covered electric wire to an inner terminal.
Figure 1C:
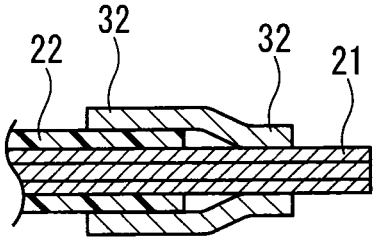
FIG. 1C is a cross-sectional view taken along a line IC-IC in FIG. 1B.

FIG. 1C is a cross-sectional view taken along the line IC-IC in FIG. 1B, and it is found that the front part 31 of the inner terminal 30 is compressed to the conductor part 21 of the covered electric wire 20 without a gap, and the rear part 32 of the inner terminal 30 is compressed to the covering section 22 of the covered electric wire 20 without a gap.

Figure 2A:
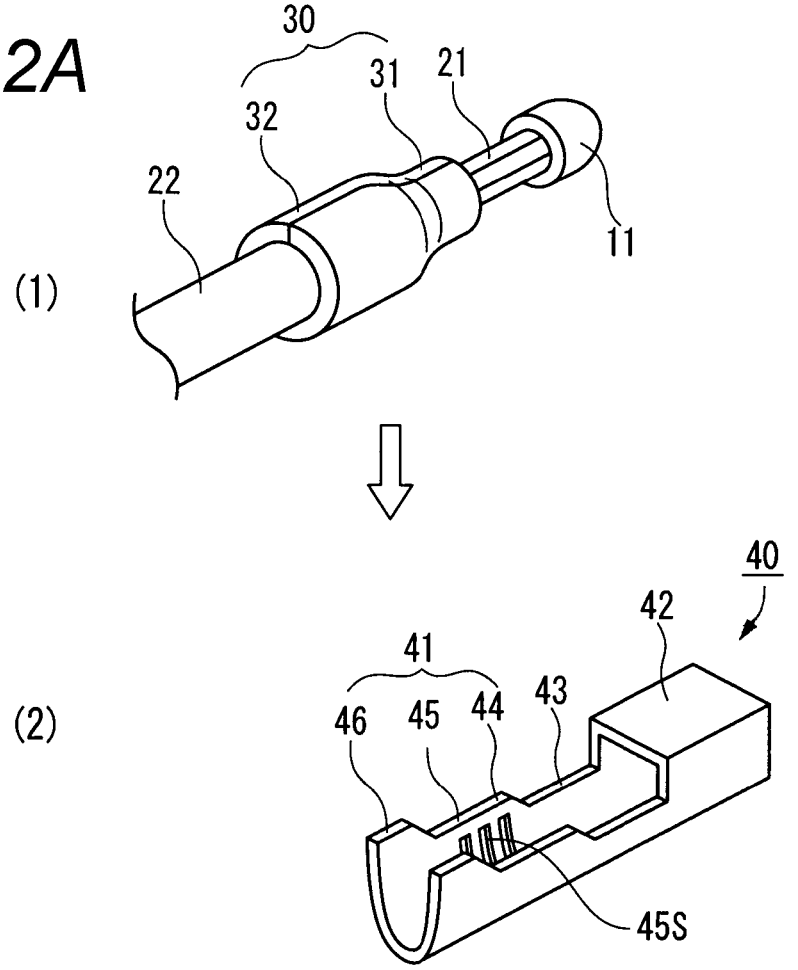
FIG. 2A is a perspective view before compressing an outer terminal to an electric wire with the inner terminal, in which (1) is a perspective view of the electric wire with the inner terminal made by assembling the seal sleeve to the tip of the conductor part of the covered electric wire, and (2) is a perspective view of the outer terminal to be compressed to the electric wire with the inner terminal.

In FIG. 2A, (1) shows a state where the seal sleeve 11 according to the embodiment is assembled to the tip of the conductor part 21 of the electric wire with the inner terminal obtained in this manner.

<Seal Sleeve 11>

The seal sleeve 11 has a cap shape made of metal or resin. The inner diameter of the seal sleeve 11 is preferably slightly greater than the diameter of a conductor part (a core wire) 21 of the covered electric wire 20 and is equal to or smaller than the outer diameter of the covering section 22. The depth (a height) of an internal space of the seal sleeve 11 is long such that the tip of the conductor part 21 of the covered electric wire 20 is set to the outer terminal 40 (FIG. 3) in a state of coming into contact with the inside of the seal sleeve 11 (FIG. 2B), and can be crimped together with the tip of the conductor part 21 by the front part 44 thereof.

Next, the electric wire with the inner terminal assembled with the seal sleeve 11 is crimped by an outer terminal 40 shown in (2) of FIG. 2A.

<Outer Terminal 40>

In FIG. 2A, (2) is a perspective view of the outer terminal.

The outer terminal 40 is made of a conductive metal, and includes a compression section 41, an electric connection section 42 connected to a mating terminal, and an interconnecting section 43 that connects the compression section 41 with the electric connection section 42. The compression section 41 includes a front part 44, a center part 45, and a rear part 46.

The electric connection section 42 is formed in a male type or a female type, and is electrically connected to the mating terminal of the female type or the male type. In (2) of FIG. 2A, the electric connection section 42 is a hollow and elongated rectangular pole and is a female type, and the opposite male terminal is inserted to the inner hollow.

Lengths of deployment barrels are different in the front part 44, the center part 45, and the rear part 46 of the compression section 41. The rear part 46 has the longest deployment barrel. The rear part 44 is compressed to the waterproof seal sleeve 11, the center part 45 is compressed to the conductor part 21, and the rear part 46 is compressed to the front part of the inner terminal 30.

Figure 2B:
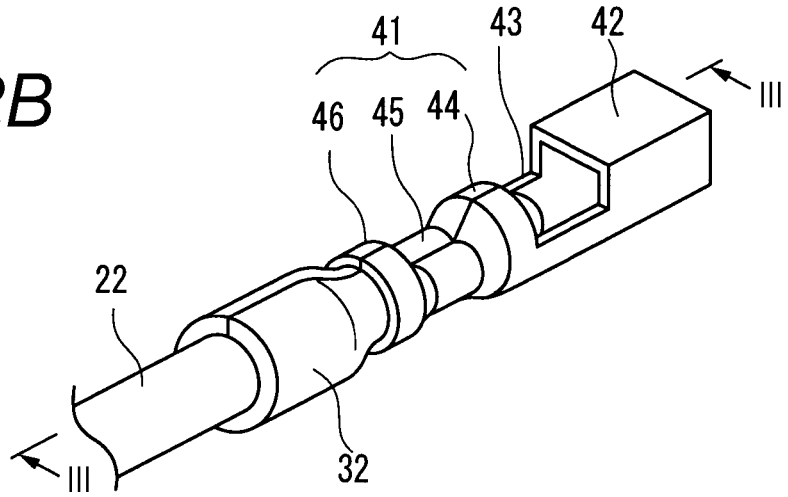
FIG. 2B is a perspective view after compressing the outer terminal to the electric wire with the inner terminal.

FIG. 2A is a perspective view before compressing the outer terminal 40 to the electric wire with the inner terminal, and FIG. 2B is a perspective view after compressing the outer terminal 40 to the electric wire with the inner terminal. As shown in (1) of FIG. 2A, when the covered electric wire 20, in which the conductor part 21 and the covering section 22 are crimped by the front part 31 and the rear part 32 constituting the crimp part of the inner terminal 30, is compressed to the outer terminal 40 shown in (2) of FIG. 2A, the electric wire with the outer terminal as shown in FIG. 2B is obtained.

In FIG. 2B, the tip of the conductor part 21, from which the covering section 22 of the covered electric wire 20 is removed, is covered by the seal sleeve 11, the front part 44 of the outer terminal 40 compresses the seal sleeve 11, the center part 45 compresses (crimps) the conductor part 21, the rear part 46 compresses the front part of the inner terminal 30, and the rear part of the inner terminal 30 compresses the covering section 22 of the covered electric wire 20. Thus, water does not enter the conductor part 21 from any part of the covered electric wire 20.

Figure 3:
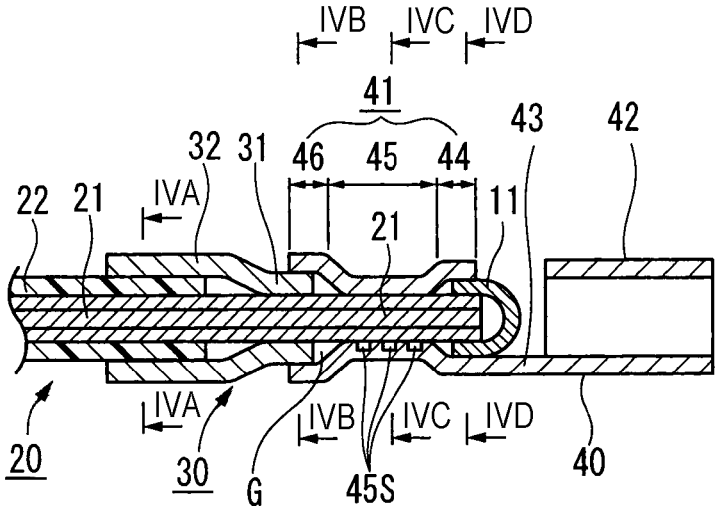
FIG. 3 is a cross-sectional view taken along a line III-III in FIG. 2B.

FIG. 3 is a cross-sectional view taken along the line III-III in FIG. 2B.

The above can also be confirmed from the cross-sectional view as shown in FIG. 3. The tip of the conductor part 21, from which the covering section 22 of the covered electric wire 20 is removed, is covered by the seal sleeve 11, and the front part 44 of the outer terminal 40 compresses the seal sleeve 11. Thus, water does not enter the conductor part 21 from the tip of the conductor part 21 of the covered electric wire 20.

Furthermore, the rear part 46 compresses the front part of the inner terminal 30, and the rear part of the inner terminal 30 compresses the covering section 22 of the covered electric wire 20. Thus, water does not enter the conductor part 21 of the covered electric wire 20 from the middle thereof.

Additionally, since a serration 45S formed of concave and convex long grooves is formed inside the center part 45, the conduction between the center part 45 and the conductor part 21 is secured.

<Serration 45S>

The center part 45 serves as a crimp part of the conductor part 21. As shown in (2) of FIG. 2A, the serration 45S formed of concave and convex long grooves is formed inside the center section 45. The serration 45S in (2) of FIG. 2A is realized by a plurality of concave grooves or convex sections which are extended in a direction vertically crossing the axis and are parallel to each other. Herein, by forming the concave grooves with respect to the surface of the crimp part so as to be parallel to each other, the surface of the crimp part between two concave grooves adjacent to each other becomes a convex section, and a plurality of concave and convex grooves parallel to each other is realized. By forming such a serration 45S, the conductor part 21 and the center part 45 cannot be relatively moved.

Furthermore, on the contrary, by forming the convex section with respect to the surface of the center part 45 so as to be parallel to each other, the surface of the crimp part between the two convex sections adjacent to each other becomes the concave surface, and it is also possible to realize a plurality of concave and convex grooves parallel to each other.

In addition, although the serration 45S is realized by a plurality of linear concavities and convexities herein, as will be described in FIGS. 6A to 6C, it is also possible to realize the serration by rectangular concavities and convexities, diamond-shaped concavities and convexities, or circular concavities and convexities.

The serration 45S mentioned above is formed in the center part, whereby the serration 45S of the center part 45 enters the conductor part 21, and the conduction with the conductor part 21 is secured.

<Gap is Not Present in Any Cross-Section>

Figure 4A:
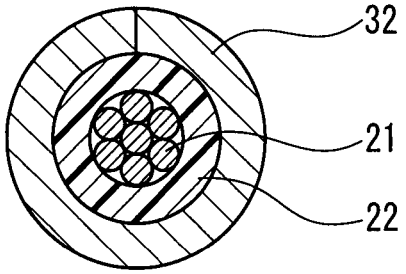
FIG. 4A is a cross-sectional view taken along a line IVA-IVA in FIG. 3.
Figure 4B:
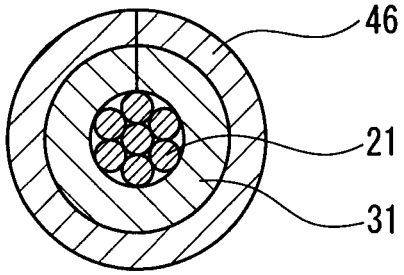
FIG. 4B is a cross-sectional view taken along a line IVB-IVB in FIG. 3.
Figure 4C:
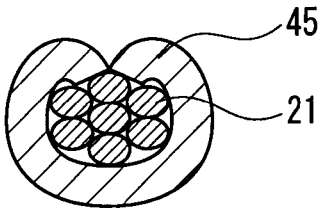
FIG. 4C is a cross-sectional view taken along a line IVC-IVC in FIG. 3.
Figure 4D:
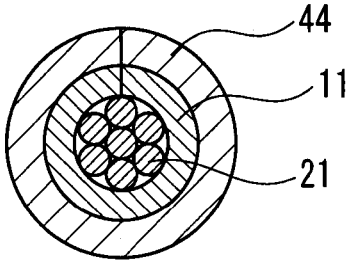
FIG. 4D is a cross-sectional view taken along a line IVD-IVD in FIG. 3.

FIG. 4A is a cross-sectional view taken along the line IVA-IVA in FIG. 3, FIG. 4B is a cross-sectional view taken along the line IVB-IVB in FIG. 3, FIG. 4C is a cross-sectional view taken along the line IVC-IVC in FIG. 3, and FIG. 4D is a cross-sectional view taken along the line IVD-IVD in FIG. 3.

(a) In a longitudinal cross-sectional view of the rear part 32 of the inner terminal 30 shown in FIG. 4A, since the rear part 32 of the inner terminal 30 is compressed to the covering section 22 of the covered electric wire 20, and a gap is not present between the rear part 32 of the inner terminal 30 and the covering section 22 of the covered electric wire 20, water does not enter therefrom.

(b) In a longitudinal cross-sectional view of the front part 31 of the inner terminal 30 shown in FIG. 4B, since the rear part 46 of the outer terminal 40 is compressed to the front part 31 of the inner terminal 30, and a gap is not present between the rear part 46 of the outer terminal 40 and the front part 31 of the inner terminal 30, water does not enter therefrom.

(c) In a longitudinal cross-sectional view of the center part 45 of the outer terminal 40 shown in FIG. 4C, since the center part 45 of the outer terminal 40 crimps (or compresses) the conductor part 21 of the covered electric wire 20 and the center section 45 is formed with the serration 45S, the center part 45 penetrates into the conductor part 21 and the conduction is secured.

(d) In a longitudinal cross-sectional view of the front part 44 of the outer terminal 40 shown in FIG. 4D, since the front part 44 of the outer terminal 40 is compressed to the seal sleeve 11 and a gap is not present between the front part 44 and the seal sleeve 11, water does not enter therefrom.

In this manner, according to the embodiment of the present invention, water does not enter any location of the covered electric wire 20 in the longitudinal direction. Thus, even in the aluminum electric wire and the electric wire with the terminal using the copper terminal, galvanic corrosion due to the electric potential difference between the different metals is not generated, and thus, there is no concern that the electric resistance of the compression section may rise and the mechanical fixing force may drop.

Figure 5:
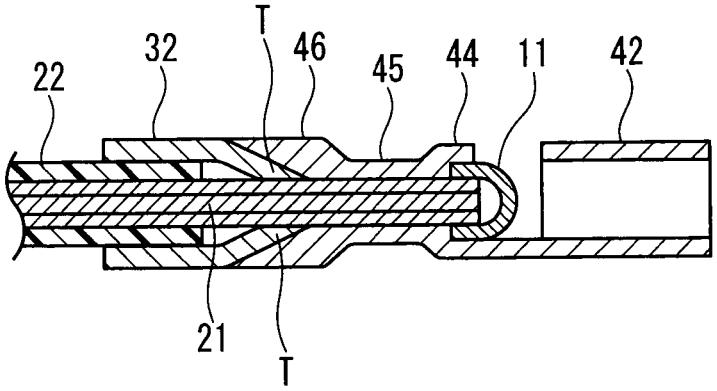
FIG. 5 is a longitudinal cross-sectional view of an electric wire with a terminal according to a second embodiment.

The electric wire with the terminal according to the first embodiment of the present invention has been described above. FIG. 5 is a longitudinal cross-sectional view of the electric wire with the terminal according to a second embodiment. The second embodiment is different from the first embodiment in that a taper T sloping while causing its diameter to be narrower as goes forward is formed at least somewhere in the front part 31 of the inner terminal 30 or the rear part 46 of the outer terminal 40 in advance.

In this manner, as shown in FIG. 5, the taper T can be formed in the compression part between the front part 31 of the inner terminal 30 and the rear part 46 of the outer terminal 40, a gap is not formed in the compression part between them, the compression effect is increased, and a step is not formed outside the compression part between them. On the contrary, in FIG. 3 that is the first embodiment, a gap G is generated between the front part 31 of the inner terminal 30 and the rear part 46 of the outer terminal 40, and the gap can be formed outside the compression part between them.

<Modified Example of Serration 45S>

Figure 6A:
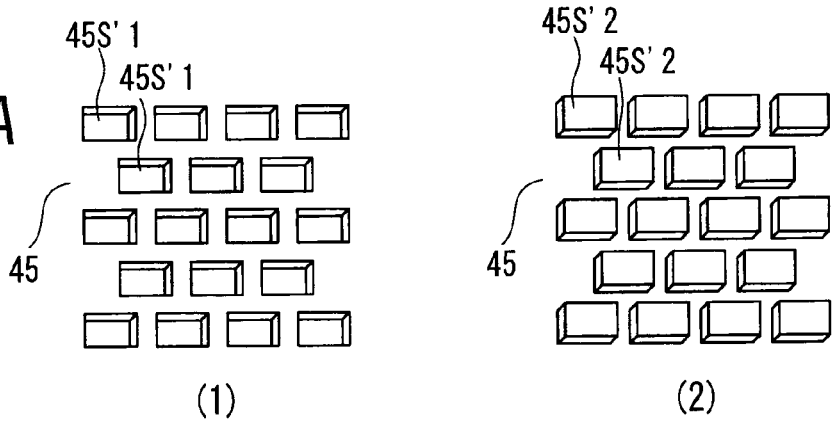
FIG. 6A is a plan view of rectangular concave serrations (1) and convex serrations (2), which are formed on a surface of the center part of the outer terminal.
Figure 6B:
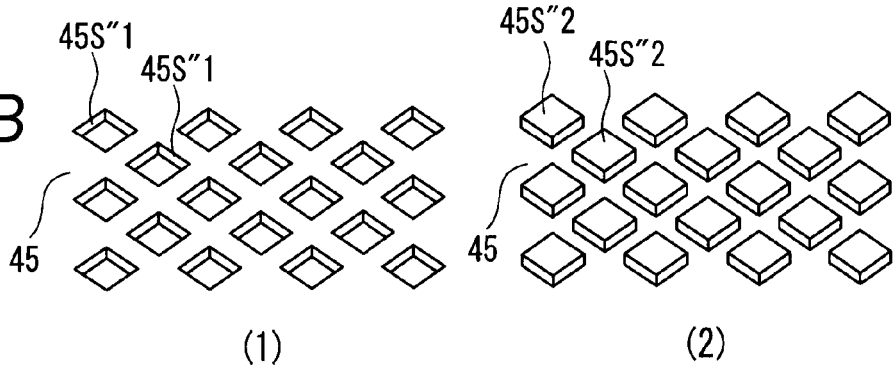
FIG. 6B is a plan view of diamond-shaped concave serrations (1) and convex serrations (2), which are formed on a surface of the center part of the outer terminal.
Figure 6C:
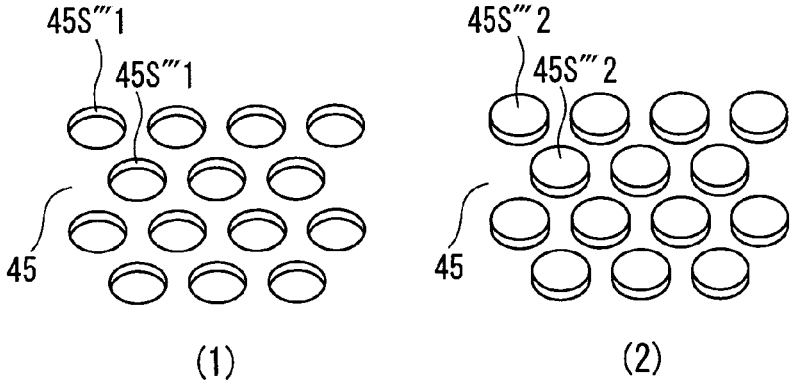
FIG. 6C is a plan view of circular concave serrations (1) and convex serrations (2), which are formed on a surface of the center part of the outer terminal.

FIGS. 6A to 6C are plan views that show other suitable serrations replacing the serration 45S using the long grooves formed in the center part 45 of the outer terminal 30 (FIG. 2A (2)), FIG. 6A is an example of a serration 45S' of the rectangular shape, FIG. 6B is an example of a serration 45S" of the diamond shape, and FIG. 6C is an example of a serration 45S'" of the circular shape. Furthermore, in each drawing, (1) is the serration using the concavity (the hollow) with respect to the surface of the center part 45, and (2) is the serration using the convexity (the protrusion) with respect to the surface of the center part 45.

<Rectangular-Shaped Serration 45S'>

In FIG. 6A, a rectangular shape 45S' of the first row and the odd numbered rows (S'1 of the concave section and S'2 of the convex section) and a rectangular shape 45S' of the second row and the even numbered rows are placed in a zigzag manner so as to be shifted each other in a parallel direction, and form a check pattern as a whole. In this manner, since the concave and convex serrations in a check pattern are strongly compressed to the conductor part 21 of the tip of the covered electric wire 20, as in the case of the linear serration 45S, the conductor part 21 is relatively moved, and the conduction with the conductor part 21 is secured.

<Diamond-Shaped Serration 45S">

In FIG. 6B, a diamond shape 45S" of the first row and the odd numbered rows (S"1 of the concave section and S"2 of the convex section) and a diamond shape 45S" of the second row and the even numbered rows are placed in a zigzag manner so as to be shifted each other in a parallel direction, and form a check pattern as a whole. In this manner, since the concave and convex serrations of the check pattern are strongly compressed to the conductor part 21 of the tip of the covered electric wire 20, as in the case of the linear serration 45S, the conductor part 21 is not relatively moved, and the conduction with the conductor part 21 is secured.

<Circular Shaped Serration 45S'">

In FIG. 6C, a circular shape 45S'" of the first row and the odd numbered rows (S'"1 of the concave section and S'"2 of the convex section) and a circular shape 45S'" of the second row and the even numbered rows are placed in a zigzag manner so as to be shifted each other in a parallel direction, and form a check pattern as a whole. In this manner, since the concave and convex serrations of the check pattern are strongly compressed to the conductor part 21 of the tip of the covered electric wire 20, as in the case of the linear serration 45S, the conductor part 21 is not relatively moved, and the conduction with the conductor part 21 is secured.

<Conclusion>

With the electric wire compression method according to the embodiments of the present invention, since the waterproof seal sleeve is attached to the tip of the conductor part from which the covering section is removed, and the seal sleeve is compressed and connected by the inner terminal, a gap allowing water to enter is not formed between the conductor part tip and the inner terminal. Thus, since water does not enter, even in the aluminum electric wire and the electric wire with the copper terminal, galvanic corrosion due to the electric potential difference between the different metals is not generated. Accordingly, there is no concern that the electric resistance of the compression section may rise and the mechanical fixing force may drop.

Furthermore, since the cap-shaped seal sleeve formed of metal or resin is used as the waterproof seal sleeve, waterproofing can be simply and reliably performed, and thus productivity is improved.

Additionally, since the serration is strongly compressed to the conductor part of the tip of the covered electric wire, by forming the serration including the plurality of concavities and convexities in the crimp part of the inner terminal by linear-shaped concavities and convexities, rectangular-shaped or diamond-shaped concavities and convexities, or circular-shaped concavities and convexities, the relative movement can be prevented and waterproofing is easy.

Furthermore, since only the pressing connection is performed, the facilities become cheap, and the cost can be reduced.

Furthermore, since only the pressing connection is preformed, the number of the processing step is reduced, and the cost can be reduced.

The present invention is useful when an electric wire with terminal is placed at a location where water, which can generate galvanic corrosion, may exist because water hardly enters the area of the conductor part of the electric wire due to the outer terminal which compresses the inner terminal and the seal sleeve provided at the tip of the covered electric wire.

What is claimed is:

1. An electric wire with terminal, comprising:

a waterproof seal sleeve that is attached to a tip of a conductor part of a covered electric wire from which a covering section is removed;

an inner terminal that is compressed in an area containing a boundary between the conductor part and the covering section of the covered electric wire; and an outer terminal which includes an electric connection section configured to connect to a mating terminal, a compression section having a front part, a center part and a rear part, and an interconnecting section that connects the electric connection section with the compression section, wherein the front part of the compression section compresses the waterproof seal sleeve, the center part of the compression section compresses and directly contacts the conductor part, and the rear part of the compression section compresses a front part of the inner terminal.

2. The electric wire with terminal according to claim 1, wherein the waterproof seal sleeve includes a seal sleeve having a cap shape formed of metal or resin.

3. The electric wire with terminal according to claim 1, wherein a serration formed of a plurality of concavities and convexities is provided in the center part of the compression section of the outer terminal.

4. The electric wire with terminal according to claim 1, wherein a taper sloping while causing its diameter to be narrower as goes forward is formed at least in the front part of the inner terminal or the rear part of the outer terminal to fill a gap between the front part of the inner terminal and the rear part of the outer terminal.

5. The electric wire terminal according to claim 1, wherein the waterproof seal sleeve is non-conductive.

* * * * *